US005423445A

United States Patent [19]

Montanari et al.

[11] Patent Number: 5,423,445

[45] Date of Patent: Jun. 13, 1995

[54] STACKABLE CARRY CONTAINER AND INTERCHANGEABLE INSERT BIN SYSTEM

[76] Inventors: Mark J. Montanari, P.O. Box 392, Greenfield Center, N.Y. 12833; Lee Hamiel, 250 Fort Edward Rd., Fort Edward, N.Y. 12828

[21] Appl. No.: 132,855

[22] Filed: Oct. 7, 1993

[51] Int. Cl.[6] ..... B65D 71/00

[52] U.S. Cl. ..... 220/23.83; 206/506; 206/511; 206/512; 206/510

[58] Field of Search ..... 220/23-83, 220/23-86; 206/506, 512, 511, 510

[56] References Cited

U.S. PATENT DOCUMENTS

| | | | |
|---|---|---|---|
| 1,947,932 | 2/1934 | Fante | 206/512 |
| 2,160,631 | 5/1939 | Woolsey | 206/512 |
| 2,409,749 | 10/1946 | Folst | 206/512 |
| 4,029,209 | 6/1977 | Frahm et al. | 206/510 |
| 4,234,114 | 11/1980 | Wood | 206/510 |
| 4,342,388 | 8/1982 | Torokvei | 206/510 |
| 4,618,069 | 10/1986 | Quong | 220/23.6 |
| 4,872,589 | 10/1989 | Englehart et al. | 220/771 |
| 4,911,303 | 3/1990 | Andersson | 206/511 |
| 5,117,997 | 6/1992 | Fink | 206/510 |

FOREIGN PATENT DOCUMENTS

| | | | |
|---|---|---|---|
| 1059418 | 2/1967 | United Kingdom | 206/510 |

*Primary Examiner*—Joseph Man-Fu Moy

[57] ABSTRACT

A stackable container/storage bin combination is provided and includes at least one stackable container comprising an outer circumferential portion, a plurality of legs secured about the outer circumferential portion, each of the legs having a lower portion which extends below a lower edge of the circumferential portion for defining a notch with the lower edge, and an inner tray portion positioned within and secured to the circumferential portion, the inner tray portion defining at least one storage compartment with the outer circumferential portion, and at least one removable storage bin adapted to be received in at least one storage compartment.

5 Claims, 7 Drawing Sheets

FIG. 5
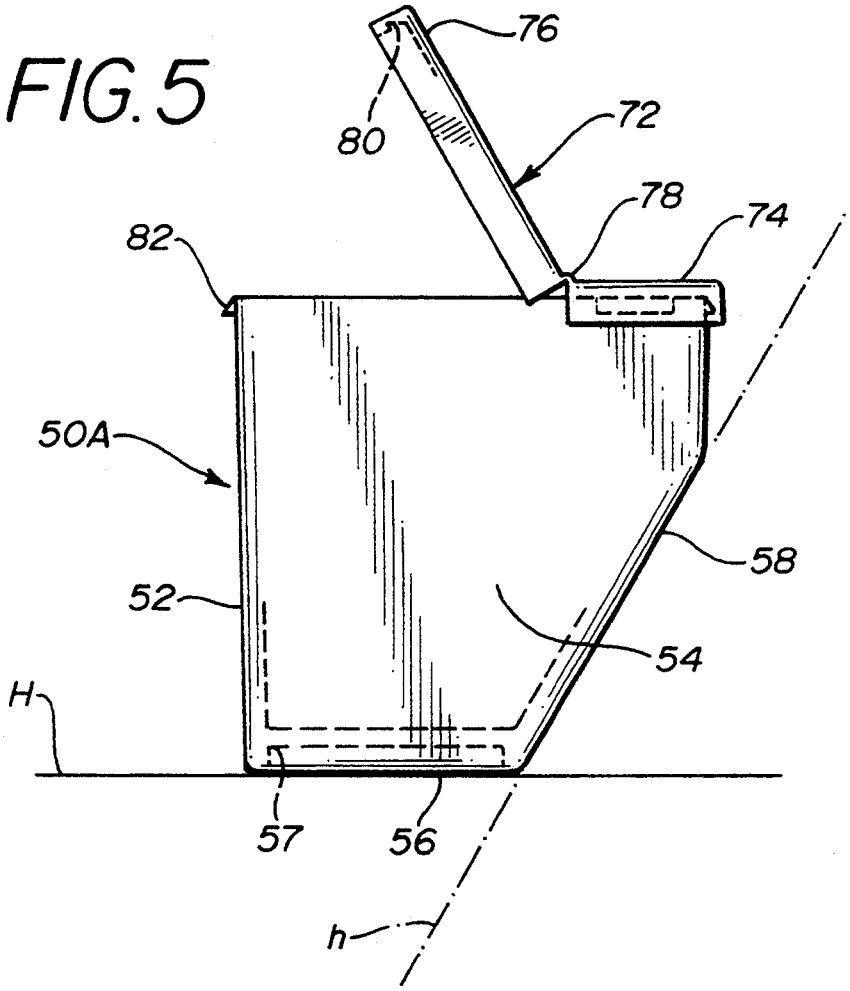
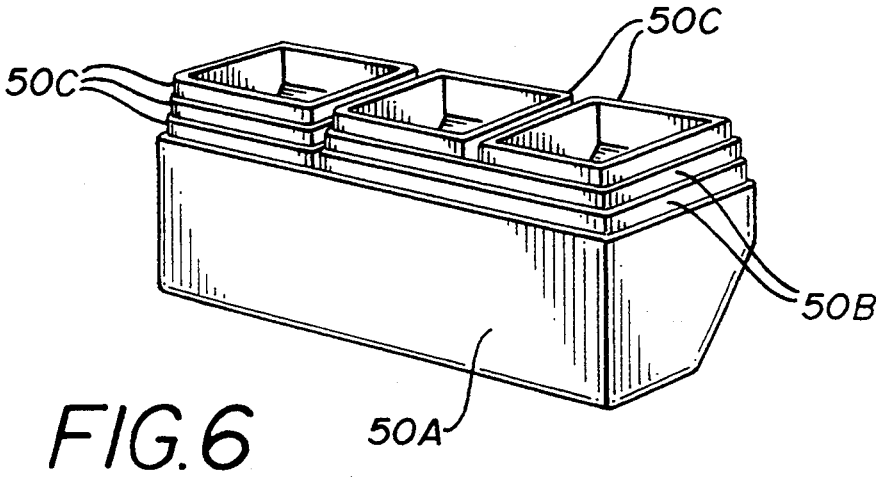
FIG. 6

STACKABLE CARRY CONTAINER AND INTERCHANGEABLE INSERT BIN SYSTEM

BACKGROUND OF INVENTION

It has become apparent that there is a lack of convenient storage and handling bin containers for the likes of nails, food, tools, etc., their transportation and storage via a carry container as a completed system. Such a system would find itself in a multitude of applications in professional, domestic, hobby and recreational use.

There does presently exist a number of Bin Containers on the market for the storage of some of the mentioned items, everything from food containers to jars, bags and shoe boxes. Carry containers do exist, these range from the make shift boxes that can hold jars, bags, and boxes to systems that are a series of bin compartments as part of the carry container.

While these systems and variations have been used extensively, they have had many limitations due to the fact that they are not designed to mix with each other or they are designed in a fixed manner (bin and carry container as one). Consequently, there was perceived a need for completed bin container's, carry container's and storage system's that are individual units that can be combined in numerous fashions to meet many of these needs for such devices.

SUMMARY OF INVENTION

The present invention provides individual containers with secured lids (covers) in a variety of sizes that can be utilized alone (a bin of nails, crayons, olives). These various sized bins can then be seated into a carry container and transported about (a carry container full of nail bins to a remote site, a carry container full of food to a picnic, etc,). Also, the carry container can be stacked full of bins, on top of each other for convenient storage.

Finally the present invention also has as part of its complete system the storage racks. These consist of a variety of sizes and designs of vertical surface mounted racks that hold a "row" of bins for storage. The inventions address such racks for wall mounts with fixed screws into the walls framing. A magnetic mount adaption to a vertical metal surface such as a file cabinet or refrigerator. A suction cup mounting adaption for vertical surfaces such as interior walls of a refrigerator inside a picnic cooler or any glass/plastic surfaces. A hanging hook adaption for hanging rack over swinging door (inside closets).

The bins of the present inventions can be moved from any rack to any carry container. Additionally, bins or containers can be added separately to the system at any time,

BRIEF DESCRIPTION OF DRAWINGS

FIG. 5 Is a side view of an insert bin shown with an alternate hinged cover;

FIG. 6 Is a perspective view showing stacking of a plurality of different sized insert bins;

DETAILED DESCRIPTION OF DRAWINGS

Figure 1:
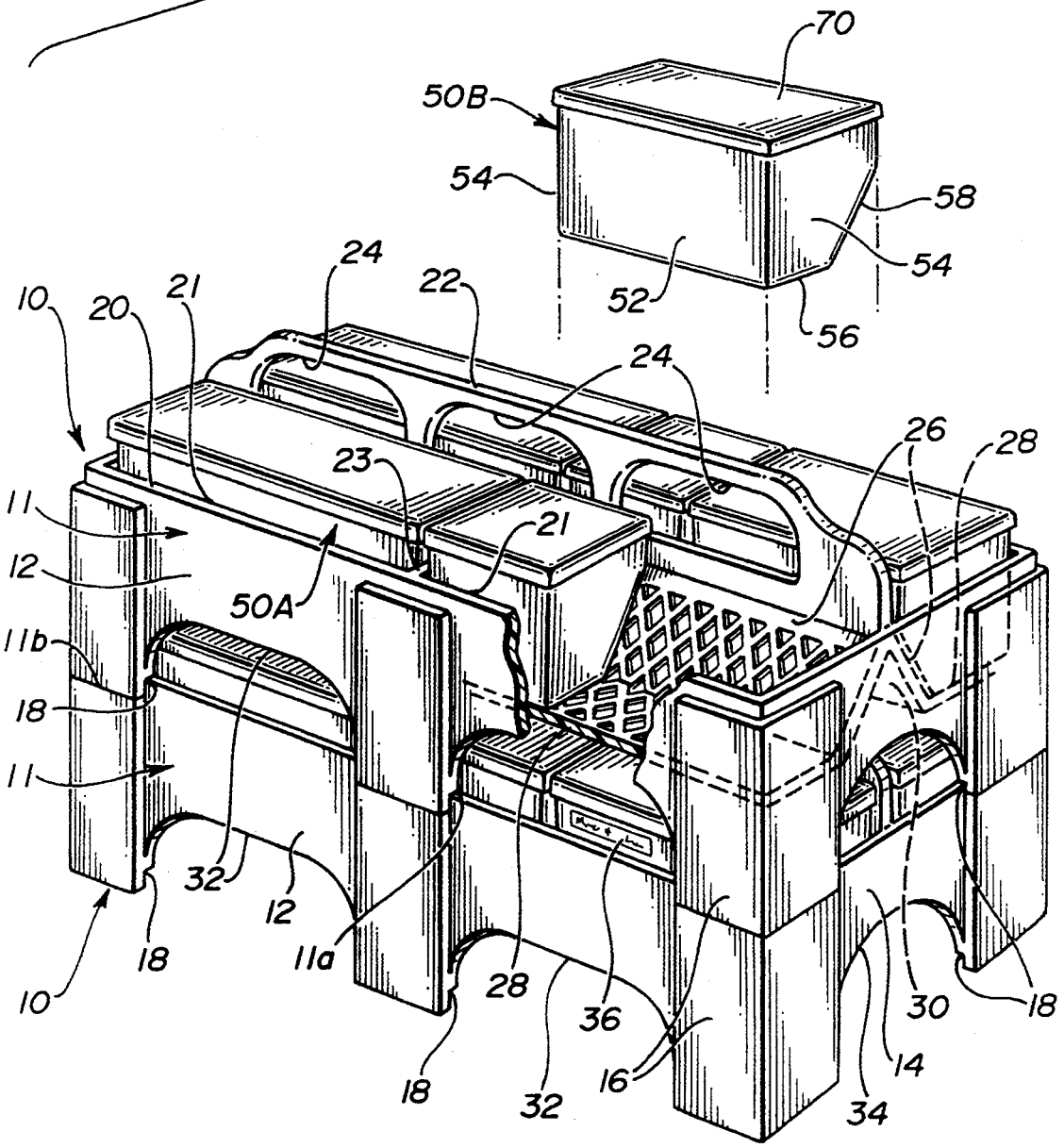
FIG. 1 Is an exploded perspective view showing two stackable containers with interchangeable inset bins of the present invention.
Figure 2:
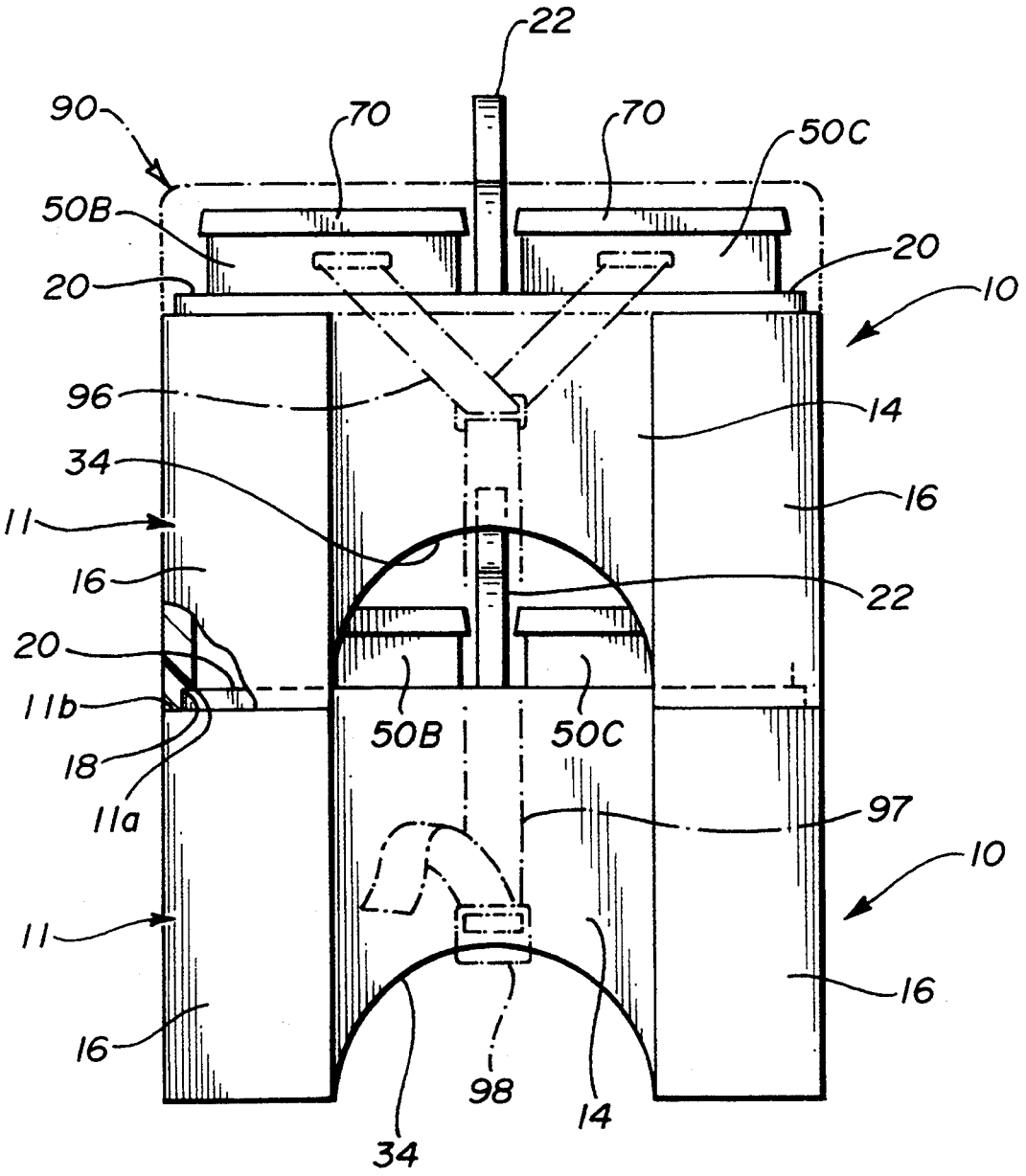
FIG. 2 Is an end elevational view thereof.
Figure 3:
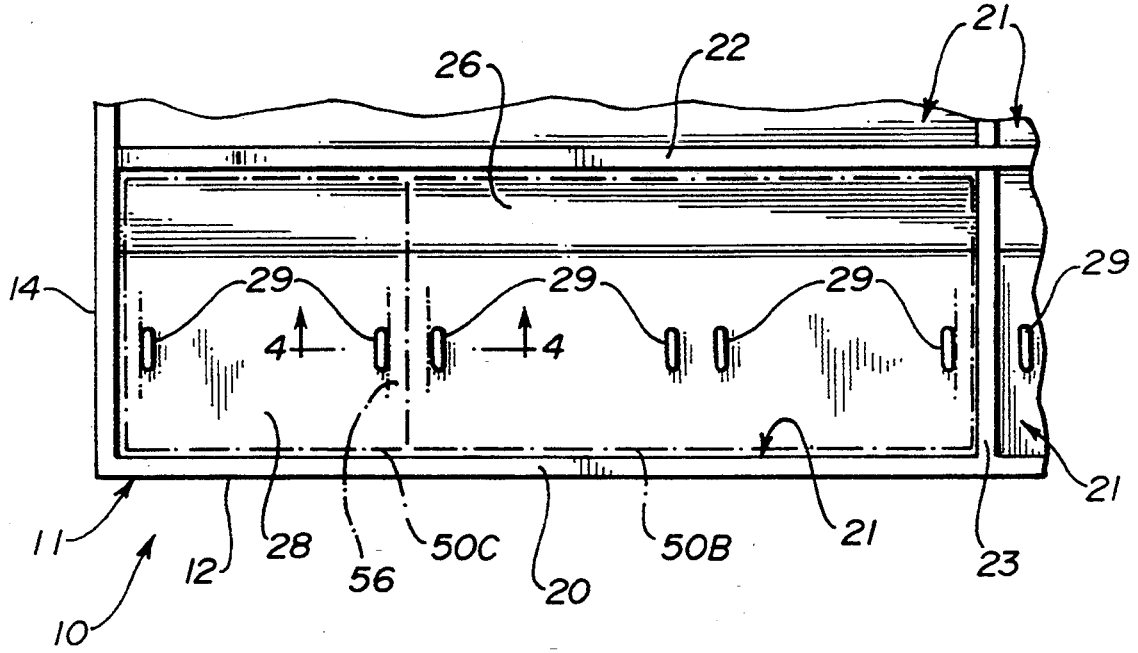
FIG. 3 Is an fragmentary top plan view of a portion of a stackable container showing retention means for the insert bin.

With reference to FIGS. 1 and 2, there are shown two stackable containers 10 positioned one upon the other, It should be understood that although two containers are shown, the stackable container of the present invention can be used as a singular carrier, several may be used in a combination. Each stackable container 10 includes an outer circumferential portion 11 defined by longitudinal side walls twelve 12 and lateral end walls 14. Extending from side walls 12 and walls 14 are leg portions 16. The bottom of each leg portion extendes beyond the lower edge 11*a* of the outer portion 11 to define a notch 18 with the lower edge 11*a*. Notch 18 is adapted to receive the upper edge 11*b* of a second stackable container 10, see FIG. 1. This allows for the stacking of a plurality of stackable containers 10. Also shown is a carry handle 22 which has a series of openings 24 for ease of handling. Extending from handle 22 is a pair of angularly disposed side walls 26 which terminate at bottom floor 28. Angled side walls 26 and floor 28 can be of an open type configuration to allow for a water drainage as shown in FIG. 1 or can be solid as shown in FIG. 3. A space 30 is created between angled side walls 26 allowing clearance for adjacent handle portions 22. Additionally there are cut out regions 32 and 34 in side walls 12 and end walls 14 respectively. These cut outs 32 and 34 allow for visual inspection of labels 36 which may be affixed to the bills of the present invention.

Now referring to FIGS. 1, 2, 4, 5, and 6, there are shown a plurality of bins 50A, 50B and 50C. Each of the bins may have a cover 70 as shown in FIGS. 1 and 2 and optionally may have a hinged cover 72 as shown in FIG. 5. Hinged cover 72 is intended to be snapped onto a bin at fixed portion 74 and free opening end 76 can rotate about hinged portion 78. Portion 76 has a cut out portion 80 which will engage a tab 82 located on the lending edge of the bin. Each of the bins 50A, 50B and 50C can either reside in the container 10 or be free standing on horizontal plane H. Optionally the bins can be oriented to lie on alternate plane H to allow for angled access when placed upon a workbench or counter top. Covers 70 and 72 can also be left off of the bins. As best seen in FIG. 1, each bin has an outside wall 52, end walls 54, bottom surface 56, and angled wall portion 58.

When the bins 50A, 50B, and 50C are emplaced within container 10, wall 52 abuts side walls 12. Bottom floor 56 rests on floor 28, and angled wall 58 rests upon angled wall 26 for the bins and the carrier respectively. The bins 50A, 50B, and 50C are designed so that for each compartment 21 in container 10, either one full size bin 50A will occupy the entire space or multiples of two-thirds sized 50 bins and one-third sized bins 50C may be used. Each container 10 has four of these compartments 21 each being defined by side wall 12, end wall 14, partition 23, the handle 24, angled wall 26 and floor 28. This allows the user to mix and match a variety of bins for a particular need. It Should be noted that an advantage accorded by the angled wall 58 in each of the bins is that any contents in the bin are urged to the front of the container towards wall 52 to allow for easy access to the contents of the bin.

Figure 4:
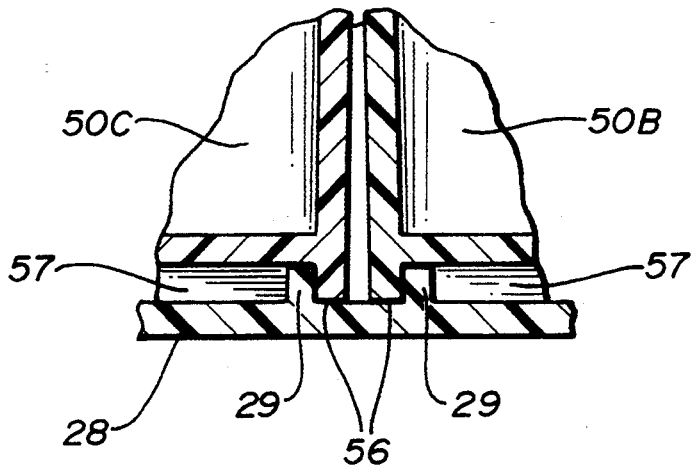
FIG. 4 Is a cross-sectional view of the retention means taking along line 4—4 of FIG. 3.

It should be understood that although the stackable container of the present invention is intended to be used in conjunction with the interchangeable insert bins, container 10 may be used either simply as a carrier with no insert bins, or with just a few insert bins. If only a few bins are used, a means may be provided in the floor 28 of the container 10 to prevent longitudinal shifting of individual bins 50B or 50C such as means is depicted in FIG. 3 and FIG. 4. Extending from the floor 28 of the container 10 are a series of projections 29 which interfit within peripheral recess 57 in the floor 56 of the bin. As shown, bin 50B only contacts the outermost projections 29 while straddling the inner most projection 29. This allows for additional flexibility when mixing and matching various sized bins. As shown in FIG. 6, the bins lend themselves to a simplistic stacking and nesting means minimizing the amount of retail display space necessary. The side walls of the bins all have a slight taper to allow for this nesting effect.

Figure 7:
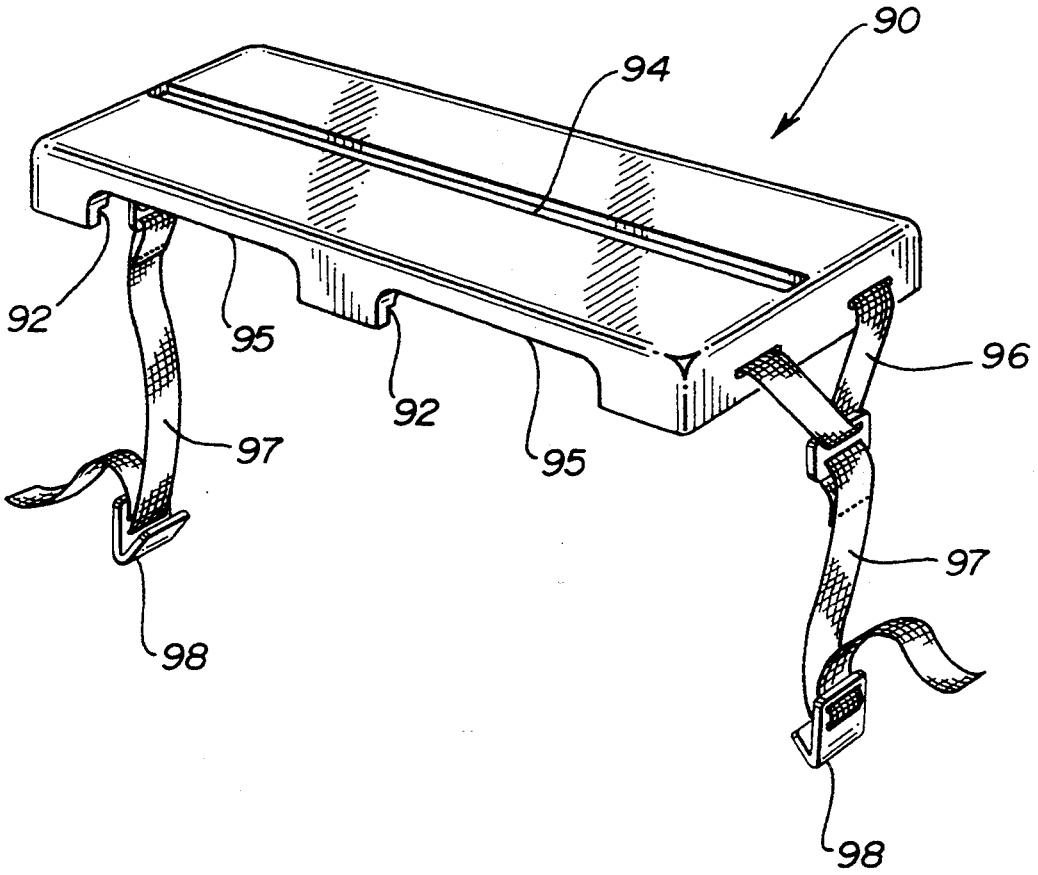
FIG. 7 Is a perspective view of a combination cover and interlocking means for the stackable containers of the present invention.

Now referring to FIG. 2 and FIG. 7, cover and interlocking means 90 for the stackable containers is shown. Cover 90 has a longitudinal slot 94 formed therein. Slot 94 allows for handle 22 of container 10 to extend through permitting the user to carry the apparatus. Stepped regions 92 fit over peripheral surface 20 of container 10 to orient cover 90 about container 10. Cut out areas 95 permit visual observation of the bins contained therein. At both ends of cover 90 are fixed straps 96, adjustable straps 97 and clip means 98. As seen in phantom in FIG. 2 the cover 90 is connected to the bottom container 10 by way of straps 96, 97, and clip 98 is secured to cut out region 34 in container 10. Alternatively cover 90 may be used for only one container 10 as a cover only. Otherwise when used for several containers, cover 90 and straps 96, 97, and clip 98 serve to secure all the containers as an interlocked group.

Figure 8:
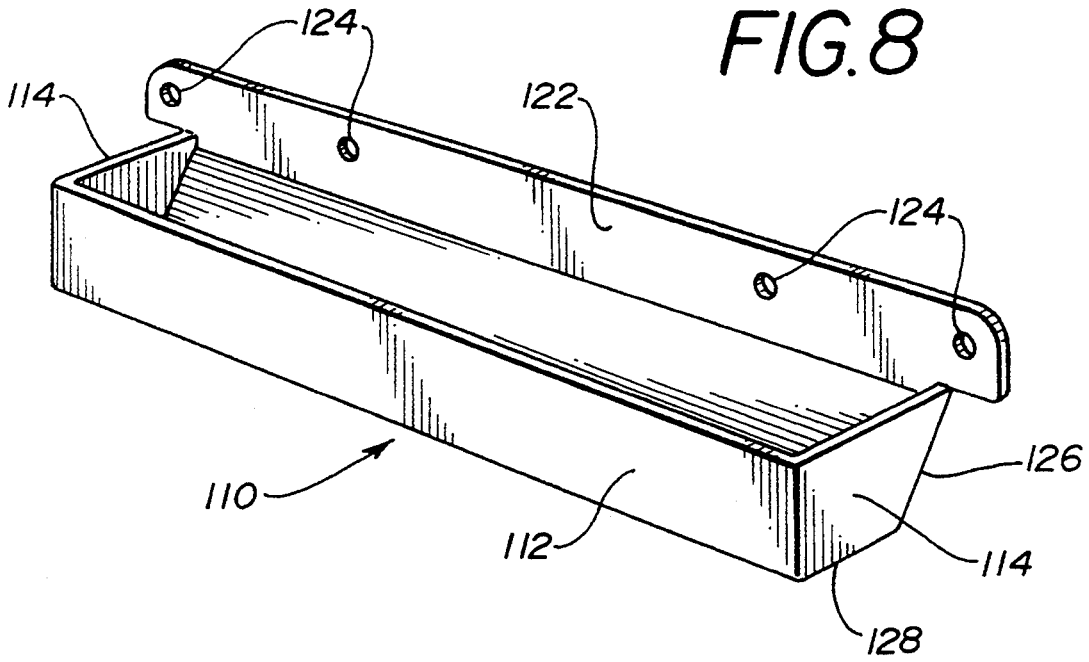
FIG. 8 Is a perspective view of a wall rack container to be used with the interchangeable insert bins of the present invention.

With reference to FIG. 8, a wall rack 110 is shown which has a side wall 112, end walls 114, angled wall 126, floor 128 and a mounting flange portion 122. Located in flange 122 are a series of holes 124 to allow for mounting with screws or other fastening means.

Although specific designs have been shown with respect to the present invention, it should be noted that a variety of different adaptions may be utilized. Such potential options may include large bulk storage bins and container systems.

Figure 9:
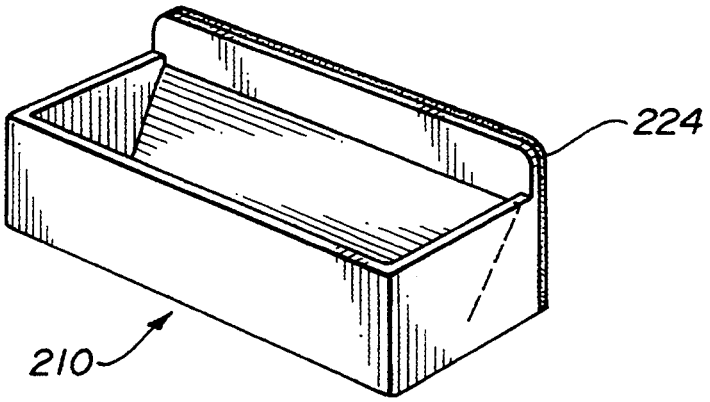
FIG. 9 Is a perspective view of another embodiment of a wall rack container wherein the mounting means is magnetic.

As shown in FIG. 9 a wall rack 210 is depicted. This rack is slightly smaller and is designed to be mounted by using magnetic means 224 or alternatively may be affixed to a surface using adhesive means. The container 210 is ideally suited for use on metal surfaces.

Figure 10:
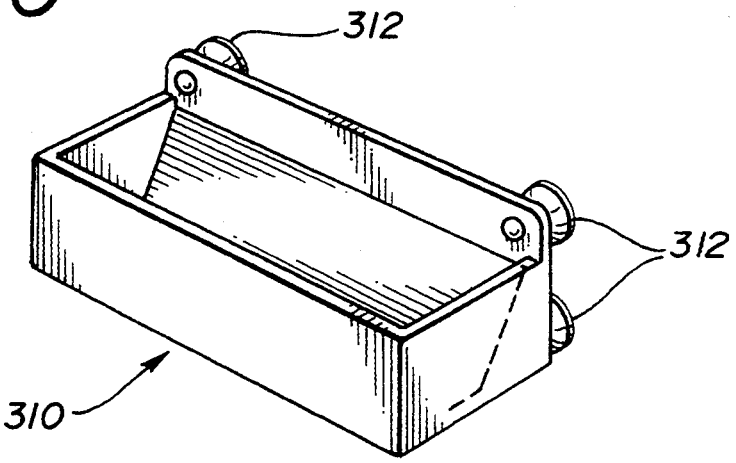
FIG. 10 Is a perspective view of another embodiement of a wall rack container wherein the mounting means are suction cups.

FIG. 10 is yet another embodiment wherein container 310 may be affixed using suction cup means 312. The container 310 is ideally suited for use in a refrigerator or any smooth non-porous surface such as glass or plastic.

Figure 11:
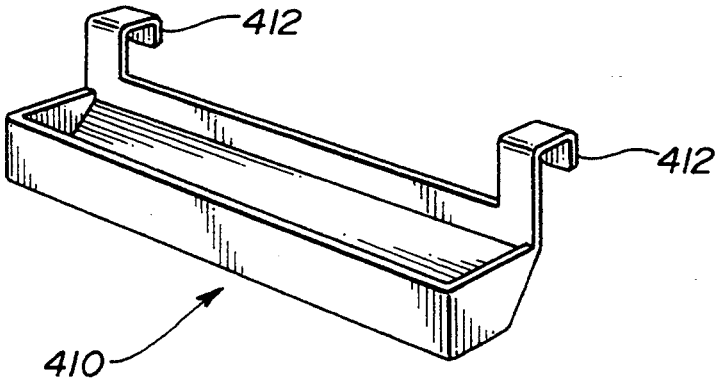
FIG. 11 Is a perspective view of another embodiment of the container means which is intended to be hung on a door.

FIG. 11 illustrates a door rack 410 which has a pair of hooks 412. Hooks 412 can be configured in a variety of widths to accommodate different sized doors such as closet doors, cabinet doors and the like.

The device of the present invention is intended to be formed of plastic: material. A variety of other material may be used, such as wood, metal and the like. Plastic is preferred for it's ease of molding, cost, light weight, structural integrity and durability.

The size, scale and geometry of the invention can be adapted for a number of related options such as:

Large bulk storage bin and container system;

Carrier style variations such as, square, round and multisided;

Bin style variations such as, cylindrical bin top with twist of caps;

A variety of different colors could be used for aesthetic purposes or to help identify the contents.

We claim:

1. A stackable container capable of being stacked on another container having an extending handle portion comprising an outer circumferential portion, a plurality of legs secured about an outer surface of said outer circumferential portion, each of said legs having a lower portion which extends below a lower edge of said cirumferential portion for defining a notch with said lower edge, and an inner tray portion positioned within and secured to said circumferential portion and defining first and second storage compartments with said outer circumferential portion for receiving at least one storage bin, said inner tray portion including a centrally located handle portion and first and second storage sections extending on opposite sides of said centrally located handle portion, said first and second storage sections being configured to allow at least a section of said extending handle portion on said another container to extend therebetween when said stackable container is stacked on said another container.

2. A stackable container as set forth in claim 1, wherein said centrally located handle portion is positioned generally in a vertical plane.

3. A stackable container as set forth in claim 2, wherein each of said first and second storage sections includes a floor portion positioned generally in a horizontal plane and a side wall portion joined to said floor portion and said centrally located handle portion and extending at an obtuse angle from said floor portion.

4. A stackable container as set forth in claim 3, wherein said floor portion of said first storage section includes a projection for engaging with a storage bin for preventing said storage bin from shifting in said first storage compartment.

5. A stackable container as set forth in claim 1, further comprising a cover having a slot for receiving said centrally located handle portion and locking straps for locking said cover onto said outer circumferential portion.

* * * * *